US007315489B2

(12) United States Patent
Houldsworth

(10) Patent No.: US 7,315,489 B2
(45) Date of Patent: Jan. 1, 2008

(54) METHOD AND APPARATUS FOR TIME MEASUREMENT

(75) Inventor: John Houldsworth, Reston, VA (US)

(73) Assignee: Powerprecise Solutions, Inc., Herndon, VA (US)

( * ) Notice: Subject to any disclaimer, the term of this patent is extended or adjusted under 35 U.S.C. 154(b) by 361 days.

(21) Appl. No.: 11/151,233

(22) Filed: Jun. 14, 2005

(65) Prior Publication Data

US 2005/0275475 A1 Dec. 15, 2005

Related U.S. Application Data

(60) Provisional application No. 60/579,620, filed on Jun. 14, 2004.

(51) Int. Cl.
*G04F 10/00* (2006.01)

(52) U.S. Cl. ..... 368/120; 368/118; 368/119

(58) Field of Classification Search ..... 368/113, 368/118, 119, 120; 702/79
See application file for complete search history.

(56) References Cited

U.S. PATENT DOCUMENTS

| | | | | |
|---|---|---|---|---|
| 2,510,485 | A * | 6/1950 | Vossberg | 340/318 |
| 4,254,492 | A * | 3/1981 | McDermott, III | 368/119 |
| 5,382,910 | A * | 1/1995 | Walsh | 324/533 |
| 7,065,668 | B2 | 6/2006 | Kosuda et al. | |
| 2004/0114469 | A1 * | 6/2004 | Duffner et al. | 368/113 |

* cited by examiner

*Primary Examiner*—P. Austin Bradley
*Assistant Examiner*—Thanh S. Phan
(74) *Attorney, Agent, or Firm*—DLA Piper US LLP

(57) ABSTRACT

A method is provided for accurate time measurement. Time is first measured with a first oscillator. At designated intervals, a second oscillator is activated for a period of time based on the first oscillator. The second oscillator is more accurate than the first oscillator. Pulses are then counted from the second oscillator during the period of time. The second oscillator is then turned off after the period of time. The count from the second oscillator is used as a new measurement of the period of time of the first oscillator.

21 Claims, 3 Drawing Sheets

METHOD AND APPARATUS FOR TIME MEASUREMENT

This application claims priority to and incorporates by reference Provisional Patent Application No. 60/579,620 entitled "Battery State-of-Charge Monitor with Low Power Clock Circuit" filed Jun. 14, 2004.

FIELD OF THE INVENTION

The present invention relates generally to devices that measure time.

DESCRIPTION OF EMBODIMENTS OF THE INVENTION

Figure 1:
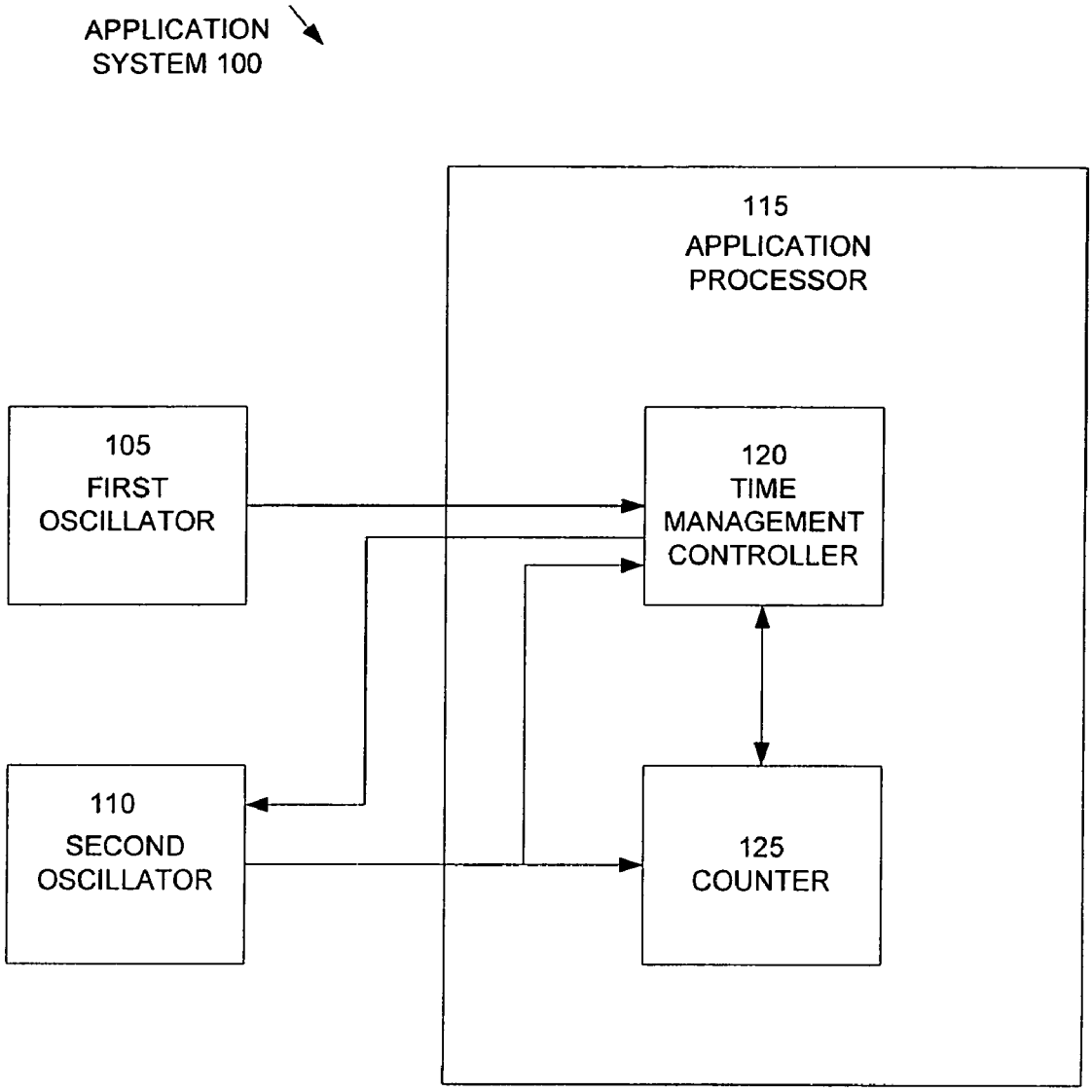
FIG. 1 illustrates a time measurement system 100, according to one embodiment of the invention.

FIG. 1 illustrates an application system 100, according to one embodiment of the invention. The system 100 uses two oscillator circuits to be used in an accurate time measurement, while conserving energy. The system 100 can be used in any device that needs to measure time, such as a battery management system (e.g., state of charge monitor), or a clock. The system 100 can be used to provide an accurate, but also low power time measurement. In one embodiment of the invention, the system includes a first oscillator 105 and a second oscillator 110, which are of different qualities. The first oscillator 105 consumes lower power than the second oscillator 110, but is less accurate in time measurement. In one embodiment, the first oscillator 105 runs continuously. For example, if used in a battery management system, the first oscillator 105 would run continuously, regardless of whether the battery is sitting on a shelf or being actively used. In addition, in one embodiment, the power consumption of the first oscillator 105 is maintained low by running the first oscillator 105 at a frequency lower than the second oscillator 100, and thus minimizing the number of transitions of its output. For example, the frequency of the first oscillator 105 could be around 4 Hz. The first oscillator 105 is used by application processor 115 time measurement for the particular application being implemented, such as a battery management system. The second oscillator 110 consumes more power than the first oscillator 105, but is more accurate in time measurement. In one embodiment, the second oscillator 110 is capable of being disabled and consumes negligible power when disabled. The second oscillator 110 may also be of a higher frequency than the first oscillator 105. For example, its frequency could be between 1 kHz and 10 MHz. The application processor 115 has a time management controller 120 and a counter 125. Periodically, the second oscillator 110 is turned on by the time management controller 120 and is used to measure the period or frequency of the first oscillator 105 by counter 125 counting the output of second oscillator 110 between selected transitions of the output of first oscillator 105. This accurately measured period of the first oscillator 105 is then used by the time management controller 120 to compensate the first oscillator 105 to a more correct time measurement.

Figure 2:
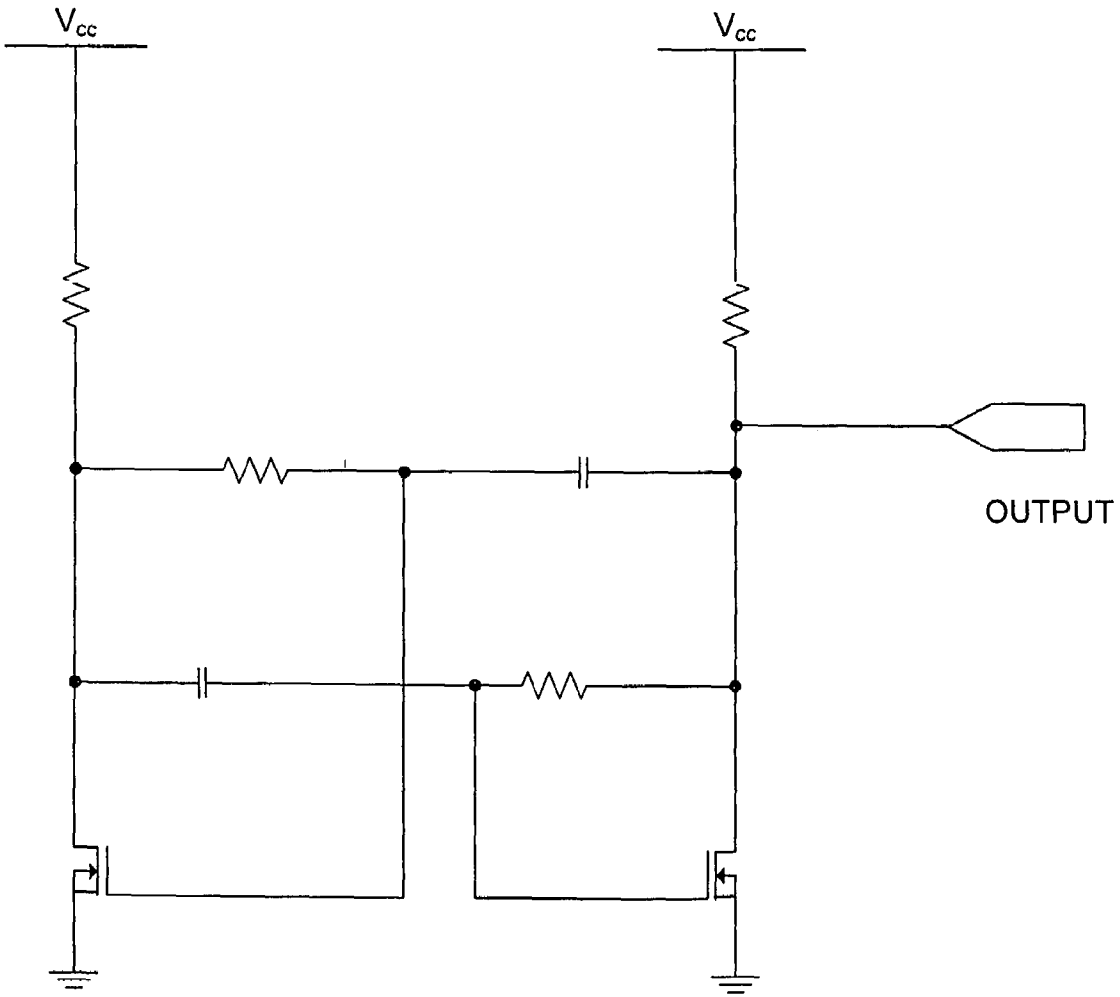
FIG. 2 illustrates a method of implementing an oscillator, according to one embodiment of the invention.

First oscillator 105 can be of the simple form illustrated in FIG. 2. Second oscillator 110 can be a higher accuracy crystal oscillator. Note that multiple other methods of implementing the oscillators may be used. For example, the first oscillator 105 can comprise, but is not limited to: a low frequency resistor/capacitor (RC) oscillator, a relation oscillator, and/or a trimmable RC oscillator. As other examples, the second oscillator 110 can comprise, but is not limited to: a crystal oscillator (e.g., >1 MHz) and/or a ceramic resonator (e.g., >1 MHz).

Figure 3:
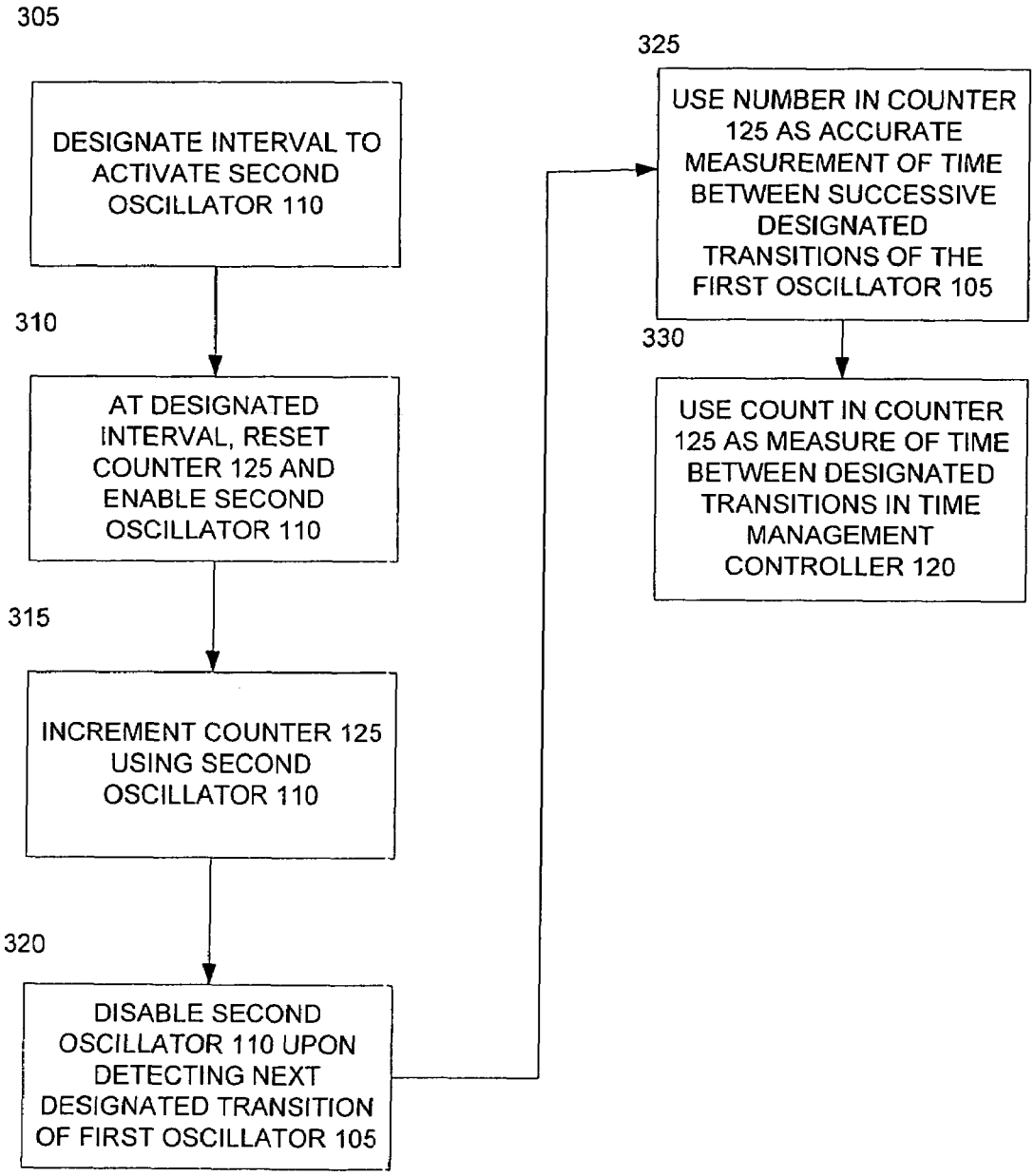
FIG. 3 illustrates a method of using the time measurement system 100, according to one embodiment of the invention.

FIG. 3 illustrates a method of using the system 100, according to one embodiment of the invention. This method provides for an accurate time measurement using the first and second oscillators 105 and 110. By periodic compensation of the first oscillator 105 by the second oscillator 110, the overall system power consumption is minimized while still keeping an accurate time measurement. This element is useful in devices that need a low-power accurate clock, such as in a battery state-of-charge (SOC) monitor, a low-power clock, systems with both active and sleep states where the elapsed time of the sleep state needs to be accurately known, etc.

Turning to FIG. 3, in step 305, a designated interval N is determined, upon which the second oscillator 110 is activated so that it can be used to measure the first oscillator 105. The interval N can be determined by a user. Alternatively, the time management controller 120 may determine this interval N according to multiple algorithms.

For example, in one embodiment, a fixed time interval N can be used. The interval N may, for example, be the period of time in which 256 rising edges of the output of the first oscillator 105 occurs.

In another embodiment, the time management controller 120 can adjust the interval N by determining if the change in the period of time of the first oscillator 105 since the last transition is within an acceptable error margin. If so, then the interval N between measurements can be increased, such as by doubling, tripling, etc. the period of time between measurements to 2N, 3N, etc. Conversely, if the change in the period of time of the first oscillator 105 since the last measurement is outside an acceptable error margin, the interval N between measurements is decreased, such as by halfing, thirding, etc. the period of time between measurements to ½N, ⅓N, etc. This algorithm may be used repeatedly such that the intervals between measurements can become very long (for the case where the environment and hence the first oscillator 105 is stable), or very short (for the case where the environment and hence the first oscillator 105 is rapidly changing). This algorithm may be thought of as expending just enough power in order to stay within the desired frequency error budget of the first oscillator 105.

In an additional embodiment, the time management controller 120 can anticipate the amount which a time measurement will change over an interval N. This is accomplished by looking at the amount the time measurement has changed between intervals in the past and assuming the same amount of change will occur in the future. In this way, the time management controller 120 can anticipate the drift that will occur over the period of time, and adjust the system 100 accordingly.

In step 310, at the designated interval, the second oscillator 110 is enabled and the counter 125 is reset. In step 315, the counter 125 is incremented using the output of the second oscillator 110. In step 320, when the time management system 115 detects a designated transition of the first oscillator 105 to define a period of time, e.g., the next rising edge, it disables the second oscillator 110 or stops the counter 125. In step 325, the number stored in the counter 125 is now an accurate measure of the period of time between successive rising edges of the first oscillator 105. Thus, the frequency or period of the first oscillator 105 is now accurately known. In step 330, this accurate value of the frequency or period is used in the time management controller 120 and application processor 115. This accurate measurement can be used in any application that needs an accurate low-power time measurement. For example, in a battery management system, the accurate value can be used in the algorithms for integrating current over a period of time in order to measure charge drained from the battery.

What is claimed is:

1. A method for accurate time measurement, comprising:
measuring time with a first oscillator;
at designated intervals, activating a second oscillator for a period of time based on the first oscillator, the second oscillator being more accurate than the first oscillator;
generating a count based on the second oscillator during the period of time;
turning off the second oscillator after the period of time; and
using the count as a measurement of the period of time of the first oscillator.

2. The method of claim 1, wherein the designated intervals are of a fixed number of periods based on the first oscillator.

3. The method of claim 1, further comprising:
if a change between the count and a previous count are within an accepted error margin, then increasing the designated intervals.

4. The method of claim 3, wherein the designated intervals are doubled.

5. The method of claim 3, further comprising:
if the change between the count and the previous count are outside the acceptable error margin, then decreasing the designated intervals.

6. The method of claim 5, wherein the designated intervals are cut in half.

7. The method of claim 1, wherein the second oscillator requires higher power than the first oscillator.

8. The method of claim 1, wherein a user determines when to use the second oscillator.

9. The method of claim 1, further comprising adjusting time measurements made with the first oscillator between the designated intervals based on changes in previous measurements of the period of time of the first oscillator.

10. An apparatus for accurate time measurement, comprising:
a first oscillator which measures time;
a second oscillator which is more accurate than the first oscillator;
a counter connected to count pulses from the second oscillator; and
a controller coupled to the first oscillator, the second oscillator and the counter, the controller capable of:
enabling the second oscillator at designated intervals;
enabling the counter to generate a count based on the second oscillator while the second oscillator is enabled for a period of time based on the first oscillator; and
using the count of the counter as a measurement of the period of time of the first oscillator.

11. The apparatus of claim 10, wherein the designated intervals are of a fixed number of periods based on the first oscillator.

12. The apparatus of claim 10, wherein if a change between the count and a previous count are within an accepted error margin, the controller increases the designated intervals.

13. The apparatus of claim 12, wherein the designated intervals are doubled.

14. The apparatus of claim 12, wherein if the change between the count and the previous count are outside the acceptable error margin, the controller decreases the designated intervals.

15. The apparatus of claim 14, wherein the designated intervals are cut in half.

16. The apparatus of claim 10, wherein the second oscillator requires higher power than the first oscillator.

17. The apparatus of claim 10 wherein a user determines when to use the second oscillator.

18. The apparatus of claim 10, wherein the counter is of a sufficient size so that it does not overflow during the period of time.

19. The apparatus of claim 10, wherein the controller adjusts time measurements made with the first oscillator between the designated intervals based on changes in previous measurements of the period of time of the first oscillator.

20. A method for accurate time measurement in a battery management system, comprising:
measuring time with a first oscillator;
using the measured time to determine charge removed from a battery;
at designated intervals, activating a second oscillator for a period of time based on the first oscillator, the second oscillator being more accurate than the first oscillator;
generating a count based on the second oscillator during the period of time;
turning off the second oscillator after the period of time; and
using the count from the second oscillator as a new measurement of the period of time of the first oscillator.

21. A battery management system with accurate time measurement, comprising:
a first oscillator which measures time;
a second oscillator which is more accurate than the first oscillator;
a counter connected to count pulses from the second oscillator;
a controller coupled to the first oscillator, the second oscillator and the counter, the controller capable of:
enabling the second oscillator at designated intervals;
enabling the counter to count pulses from the second oscillator while the second oscillator is enabled for a period of time based on the first oscillator; and
using the count of the counter as a new measure of the period of time of the first oscillator; and
a processor for using the period of time measured by the first oscillator to determine charge removed from a battery.

* * * * *